US007380529B2

(12) United States Patent
Finis et al.

(10) Patent No.: US 7,380,529 B2
(45) Date of Patent: Jun. 3, 2008

(54) METHOD FOR ADJUSTING AN ANGLE OF ROTATION, AND PHASE DISPLACEMENT DEVICE FOR CARRYING OUT SAID METHOD

(75) Inventors: Uwe Finis, Neuenrade (DE); Kave Kianer, Dortmund (DE); Marco Rohe, Herscheid (DE); Markus Wilke, Nurtingen (DE)

(73) Assignee: AFT Atlas Fahrzeugtechnik GmbH, Werdohl (DE)

( * ) Notice: Subject to any disclaimer, the term of this patent is extended or adjusted under 35 U.S.C. 154(b) by 0 days.

(21) Appl. No.: 10/578,738

(22) PCT Filed: Nov. 5, 2004

(86) PCT No.: PCT/DE2004/002467

§ 371 (c)(1),
(2), (4) Date: Feb. 8, 2007

(87) PCT Pub. No.: WO2005/047657

PCT Pub. Date: May 26, 2005

(65) Prior Publication Data

US 2007/0125331 A1 Jun. 7, 2007

(30) Foreign Application Priority Data

Nov. 10, 2003 (DE) ..... 103 52 851

(51) Int. Cl.
*F01L 1/34* (2006.01)

(52) U.S. Cl. ..... 123/90.15; 123/90.17; 123/90.31; 464/160

(58) Field of Classification Search ..... 123/90.11, 123/90.15, 90.16, 90.17, 90.18, 90.27, 90.31; 464/1, 160

See application file for complete search history.

(56) References Cited

U.S. PATENT DOCUMENTS

| | | | | |
|---|---|---|---|---|
| 5,218,935 | A | 6/1993 | Quinn, Jr. et al. | |
| 7,243,627 | B2 * | 7/2007 | Izumi et al. | 123/90.17 |
| 7,308,876 | B2 * | 12/2007 | Schafer et al. | 123/90.17 |

FOREIGN PATENT DOCUMENTS

| | | |
|---|---|---|
| DE | 29 22 501 | 3/1988 |
| DE | 40 22 735 | 1/1991 |
| DE | 41 22 391 | 1/1993 |

(Continued)

*Primary Examiner*—Ching Chang
(74) *Attorney, Agent, or Firm*—Volpe and Koenig, P.C.

(57) ABSTRACT

A method for adjustment of the relative angle of rotation between a camshaft and a crankshaft in an internal combustion engine through an electromechanical phase adjuster is provided. The invention provides a rapid and precise adjustment behavior. To that end, a deviation of the adjustment speed ($\Delta\Omega$) between a desired adjustment speed ($\Omega_{SOLL}$) and an actual adjustment speed ($\Omega_{IST}$) is calculated from at least one measurement parameter in a second control loop cascaded below the first control loop. An output parameter is calculated dependent on the deviation of the adjustment speed ($\Delta\Omega$) through an adjustment speed adjuster (26) cascaded below the angle of rotation adjuster (23), with the output parameter being used to adjust the angle of rotation ($\Phi$) using an electromechanical actuator (14). The relative angle of rotation can be rapidly and precisely adjusted by adjusting the adjustment speed. A phase adjuster for controlling the relative angle of rotation is also provided.

10 Claims, 5 Drawing Sheets

FOREIGN PATENT DOCUMENTS

| | | |
|---|---|---|
| DE | 196 00 853 | 7/1997 |
| DE | 102 59 134 | 7/2004 |
| DE | 103 32 264 | 2/2005 |
| WO | WO 01/11201 | 2/2001 |
| WO | WO 03/095803 | 11/2003 |

* cited by examiner

METHOD FOR ADJUSTING AN ANGLE OF ROTATION, AND PHASE DISPLACEMENT DEVICE FOR CARRYING OUT SAID METHOD

BACKGROUND

The invention relates to a method for adjusting a relative angle of rotation between a camshaft and a crankshaft in an internal combustion engine by means of an electromechanical phase adjuster. The invention further relates to a phase adjuster for carrying out such a method Electromechanical phase adjusters of the type according to this class are known from DE 100 38 354 A1 or DE 102 22 475 A1. Such phase adjusters are used for adjusting the relative angle of rotation between a camshaft and the crankshaft of an internal combustion engine. By adjusting this angle of rotation, the opening times of the inlet or outlet valves can be influenced in a targeted way, which has proven to be advantageous in the operation of internal combustion engines in terms of fuel consumption and exhaust emissions.

From DE 102 59 134 A1, an angle of rotation cascading adjustment method for such electromechanical phase adjusters is known, which uses the actuator rotational speed as a control parameter in a cascaded control loop. A disadvantage in such an angle of rotation cascading adjustment method is that the actuator rotational speed deviates from the change in time for the angle of rotation, and the angle of rotation cascading adjustment method thus exhibits poor control behavior.

SUMMARY

Starting from this background, the invention is based on the objective of providing a method for rapid and precise adjustment of the relative angle of rotation between a camshaft and a crankshaft in an internal combustion engine through an electromechanical phase adjuster.

This objective is realized according to the invention by a method with the features of Claim 1. The core of the invention provides that the change in time for the angle of rotation, designated below as adjustment speed, is calculated initially from at least one measurement parameter, which, as a rule, can be measured easily, and this adjustment speed is used as a control parameter. The actual adjustment speed calculated from at least one measurement parameter is compared with a desired adjustment speed and the resulting adjustment speed deviation is fed to an adjustment speed control device, which sets the desired adjustment speed. Therefore, because the adjustment speed is calculated from at least one measurement parameter, which, as a rule, can be measured easily, complicated and expensive direct measurement is unnecessary. Simultaneously, the method can directly use the change in time for the angle of rotation as the control parameter, which leads to a more rapid and more precise adjustment behavior of the angle of rotation.

If an actual adjustment speed is calculated according to Claim 2, then the rotational speed of the internal combustion engine superimposed on the phase adjuster is included in the calculation of the actual adjustment speed, so that a change in the operating point of the internal combustion engine acting as disturbance is stabilized instantaneously and exactly or a change in the operating point of the internal combustion engine performed simultaneously with an adjustment of the relative angle of rotation is used for adjusting the relative angle of rotation.

Calculating the superimposed rotational speed according to Claim 3 can be performed easily, because the superimposed rotational speed follows as half the rotational speed of the crankshaft.

A calculation in an monitoring module according to Claim 4 permits a very precise determination of the actual adjustment speed, because inaccuracies in the calculation of the actual adjustment speed are corrected in the monitoring module.

A desired current according to Claim 5 permits the cascading of a current control device.

A current control device according to Claim 6 cascaded below the adjustment speed control device permits an instantaneous and exact stabilization of disturbances to the current of the actuator and thus on the driving torque of the actuator. Disturbances can be produced, for example, due to the temperature dependency of resistors in the actuator.

Limiting the desired current according to Claim 7 enables an effective protection of the actuator from overloading.

Another objective of the invention is to provide a phase adjuster for carrying out a method for rapid and precise adjustment of a relative angle of rotation between a camshaft and a crankshaft in an internal combustion engine.

This objective is achieved according to the invention by a phase adjuster with the features of Claim 8. The advantages of the phase adjuster according to the invention correspond to those that were performed above in connection with the method according to the invention for adjusting a relative angle of rotation between a camshaft and a crankshaft.

An improvement according to Claim 9 leads to the advantages named in connection with Claim 6.

A DC motor according to Claim 10 permits a simple design and setting of the control device.

BRIEF DESCRIPTION OF THE DRAWINGS

The invention is described in more detail below with reference to embodiments in connection with the drawings. Shown here are.

DETAILED DESCRIPTION OF THE PREFERRED EMBODIMENTS

Figure 1:
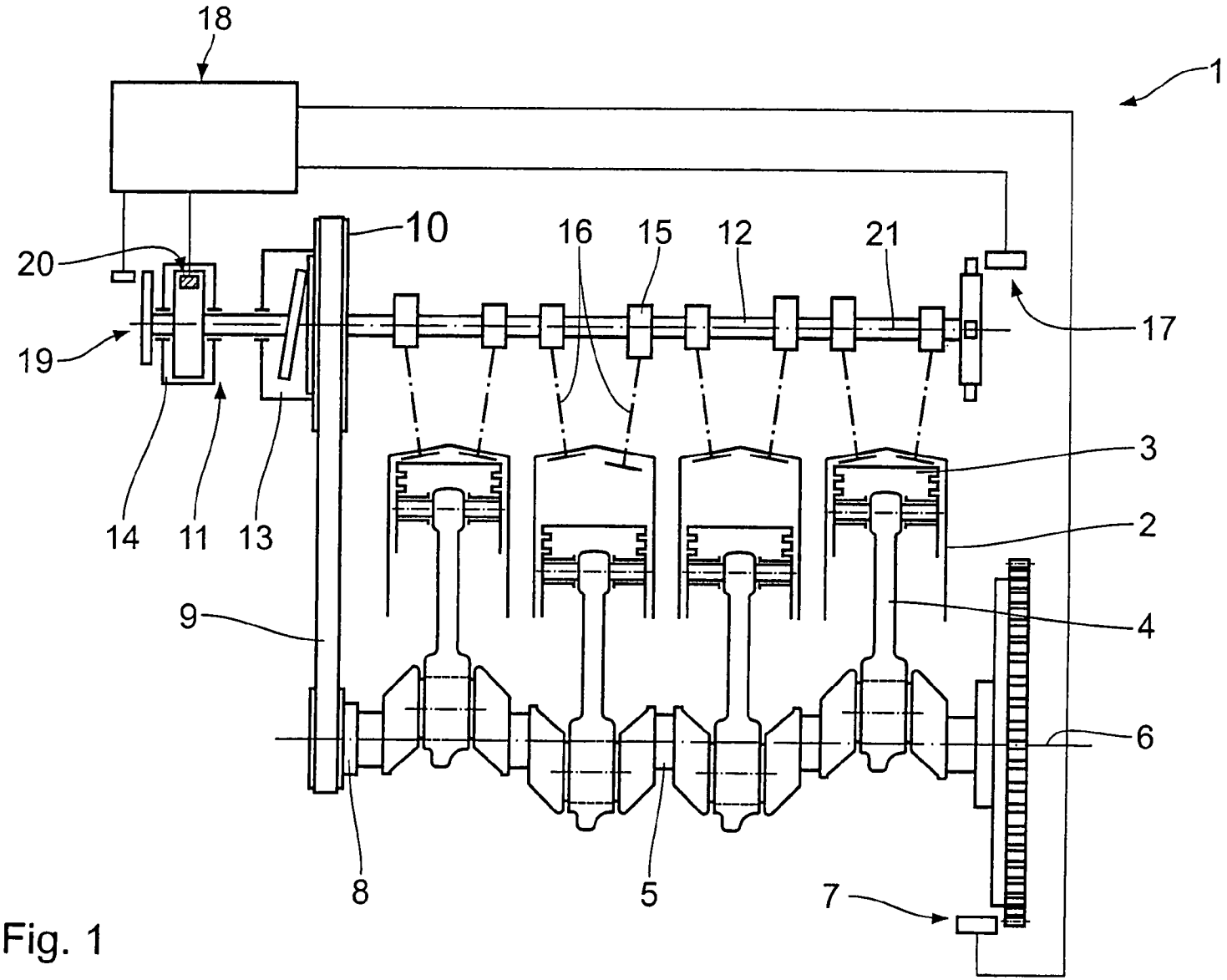
FIG. 1 a schematic diagram of an internal combustion engine with a phase adjuster, FIG. 2 a schematic view of a method for adjusting a relative angle of rotation between a camshaft and a crankshaft using a phase adjuster according to a first embodiment of the invention, FIG. 3 a schematic view of a method for adjusting a relative angle of rotation according to a second embodiment of the invention, FIG. 4 a schematic view of a method for adjusting a relative angle of rotation according to a third embodiment of the invention, and FIG. 5 a schematic view of a method for adjusting a relative angle of rotation according to a fourth embodiment of the invention.

FIG. 1 shows a conventionally built internal combustion engine 1. The internal combustion engine 1 comprises several in-line cylinders 2, in each of which a piston 3 is guided. Each piston 3 is connected to a crankshaft 5 via a connecting rod 4, with the crankshaft 5 being rotatably mounted for movement about a crankshaft rotational axis 6. A crankshaft sensor 7, which is used for measuring an angle of rotation $\Phi_K$ and a rotational speed $\Omega_K$ of the crankshaft 5, is arranged on a first end of the crankshaft 5. A crankshaft timing gear 8, which drives a valve timing gear 10 via a toothed belt 9, is arranged on a second end of the crankshaft 9. The valve timing gear 10 is coupled with an electromechanical phase adjuster 11 and a camshaft 12.

The phase adjuster 11 comprises a swash-plate mechanism 13 and an actuator 14 in the form of a DC motor, with the swash-plate mechanism 13 being connected to the DC motor 14, the valve timing gear 10, and the camshaft 12, such that an angle of rotation $\Phi_N$ of the camshaft 12 can be set. With reference to the detailed construction of the swash-plate mechanism 13, refer to DE 100 38 354 A1 and DE 102 22 475 A1.

Along the camshaft 12, there are several spaced apart cams 15, which each actuating a valve 16 for letting gas into or out of the cylinders 2. A camshaft sensor 17, which is used for measuring the angle of rotation $\Phi_N$ and the rotational speed $\Omega_N$ of the camshaft 12, is arranged on an end of the camshaft 12 facing away from the valve timing gear 10.

The phase adjuster 11 further comprises a adjusting and control device 18, which is connected to the crankshaft sensor 7, the camshaft sensor 17, a first actuator sensor 19, and a second actuator sensor 20 for transmitting measurement data. The first actuator sensor 19 is used for measuring the angle of rotation $\Phi_S$ and the rotational speed $\Omega_S$ of the DC motor 14 and the second actuator sensor 20 is used for measuring the armature current $I_S$ of the DC motor 14. For controlling the DC motor 14, the adjusting and control device 18 is connected to a power-electronics circuit (not shown), through which the DC motor 14 is actuated. Through use of the DC motor 14 and the driven valve timing gear 10, the camshaft 12 is turned about a camshaft rotational axis 21 via the swash-plate mechanism 13.

For changing the opening times of the valves 16, a relative angle of rotation $\Phi$ between the camshaft 12 and the crankshaft 5 is defined, which is calculated with $\Phi=\Phi_N-\Phi_K$. The adjustment speed $\Omega$ is defined as the change in time for the relative angle of adjustment $\Phi$ with the dimension °/sec. In particular, the adjustment speed $\Omega$ is related to the crankshaft 5 and thus has the units ° crankshaft/sec. The rotational speed of the valve timing gear 10 is designated below as superimposed rotational speed $\Omega_{Ü}$. Due to the fixed coupling between the crankshaft 5 and the valve timing gear 10 by means of the toothed belt 9, the superimposed rotational speed is given by $\Omega_0=\Omega_K/2$.

In the stationary operation of the phase adjuster 11, i.e., if no change of the relative angle of rotation $\Phi$ is necessary, due to the structural construction of the swash-plate mechanism 13, the DC motor 14 must always rotate at the superimposed rotational speed $\Omega_{Ü}=\Omega_K/2$, so that the relative angle of rotation $\Phi$ between the camshaft 12 and the crankshaft 5 remains constant. If the relative angle of rotation $\Phi$ is to be changed, then the DC motor 14 must turn either faster or slower than the superimposed rotational speed $\Omega_{Ü}=\Omega_K/2$ according to the direction of rotation. By changing the angle of rotation $\Phi$, the opening times of the valves 16 are changed, whereby the operating behavior of the internal combustion engine 1 is changed.

Figure 2:
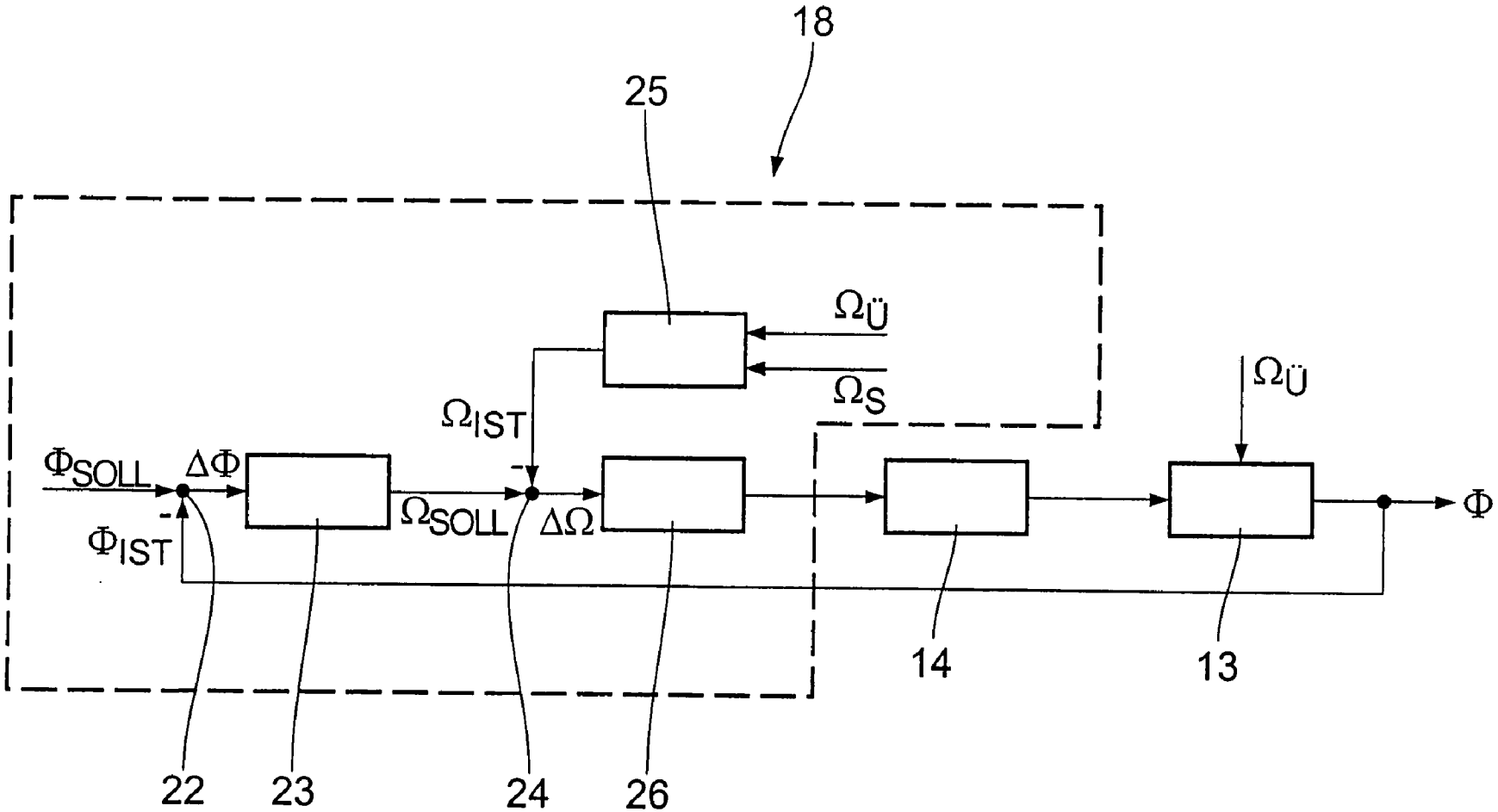

A method for adjusting the relative angle of rotation $\Phi$ realized in the adjusting and control device 18 of the phase adjuster 11 according to a first embodiment is described in more detail below with reference to FIG. 2. In a first computing module 22, first a deviation $\Delta\Phi$ of the angle of rotation between a desired angle of rotation $\Phi_{SOLL}$ to be set and a calculated actual angle of rotation $\Phi_{IST}$ is calculated. The deviation $\Delta\Phi$ of the angle of rotation is then fed to an angle of rotation adjuster 23, in which a desired adjustment speed $\Omega_{SOLL}$ dependent on the deviation $\Delta\Phi$ of the angle of rotation is calculated. The desired angle of rotation $\Phi_{SOLL}$ is given by a higher-order motor control device (not shown). The actual angle of rotation $\Phi_{IST}$ can be determined either through direct measurement, as is known from DE 102 36 507 A1, or can be calculated from existing measurement parameters, such as, for example, the angle of rotation $\Phi_K$ of the crankshaft 5, the angle of rotation $\Phi_N$ of the camshaft 12, and the angle of rotation $\Phi_S$ of the DC motor 14. If the measurement or calculation of the actual angle of rotation $\Phi_{IST}$ is ideal, then this corresponds to the relative angle of rotation $\Phi$.

Furthermore, in a second computing module 24, a deviation $\Delta\Omega$ between the desired adjustment speed $\Omega_{SOLL}$ and a calculated actual adjustment speed $\Omega_{IST}$ is calculated. For calculating the actual adjustment speed $\Omega_{IST}$ there is an adjustment speed computing module 25, in which the actual adjustment speed $\Omega_{IST}$ is calculated as a function of the measured rotational speed $\Omega_S$ of the DC motor 14 and the superimposed rotational speed $\Omega_{Ü}=\Omega_K/2$ of the valve timing gear 10. If the calculation of the actual adjustment speed $\Omega_{IST}$ is ideal, then this corresponds to the adjustment speed $\Omega$. The deviation $\Delta\Omega$ of the adjustment speed is fed to an adjustment speed adjuster 26 cascaded below the angle of rotation adjuster 23, in which an output parameter dependent on the deviation $\Delta\Omega$ of the adjustment speed is calculated and output. The output parameter of the adjustment speed adjuster 26 is a desired value for the current-sourcing voltage of the DC motor 14, which is set by a power-electronics circuit (not shown) on the DC motor 14. Depending on the output parameter of the adjustment speed adjuster 26, the DC motor 14 adjusts the angle of rotation $\Phi$ via the swash-plate mechanism 13 until the desired angle of rotation $\Phi_{SOLL}$ to be set is reached and the deviation $\Delta\Phi$ of the angle of rotation becomes zero. The angle of rotation adjuster 23 is part of a first control loop for adjusting the angle of rotation $\Phi$ and adjustment speed adjuster 26 is part of a second control loop for adjusting the adjustment speed $\Omega$, with the second control loop being cascaded below the first control loop.

By adjusting the adjustment speed $\Omega$, on one hand the changes in the superimposed rotational speed $\Omega_{Ü}$, the change in the operating point of the internal combustion engine, which act as disturbance parameters for the adjustment (cf. arrow in the swash-plate mechanism 13 in FIG. 2), are stabilized instantaneously and exactly in the control loop cascaded below for adjusting the adjustment speed $\Omega$; on the other hand, changes in the superimposed rotational speed $\Omega_{Ü}$ can be used in a change in the operating point taking place simultaneously with the adjustment of the relative angle of rotation $\Phi$ for the purpose to stabilize the relative angle of rotation $\Phi$ quickly. This is possible, because the superimposed rotational speed $\Omega_{Ü}$ is included in the calculation of the actual adjustment speed $\Omega_{IST}$. Therefore, because the adjustment speed $\Omega$ is adjusted directly, it is also possible that linear adjuster structures can be used for the angle of rotation adjuster 23 and the adjustment speed adjuster 26, so that the design and parameterization of the adjuster 23, 26 can be simple. In addition, the computational complexity in the adjusting and control device 18 is kept low. Through the use of linear adjuster structures, known linear methods can be applied for parameterizing the adjuster 23, 26. The cascaded control for the adjustment speed $\Omega$ permits a fast transient effect of the adjustment of the angle of rotation $\Phi$ with low overshoot and very good stationary adjusting accuracy. In addition, the number of parameters of the adjuster 23, 26 to be set is easy to understand, so that the parameterization of the adjuster 23, 26 is clear for an operator and thus can be performed easily.

Figure 3:
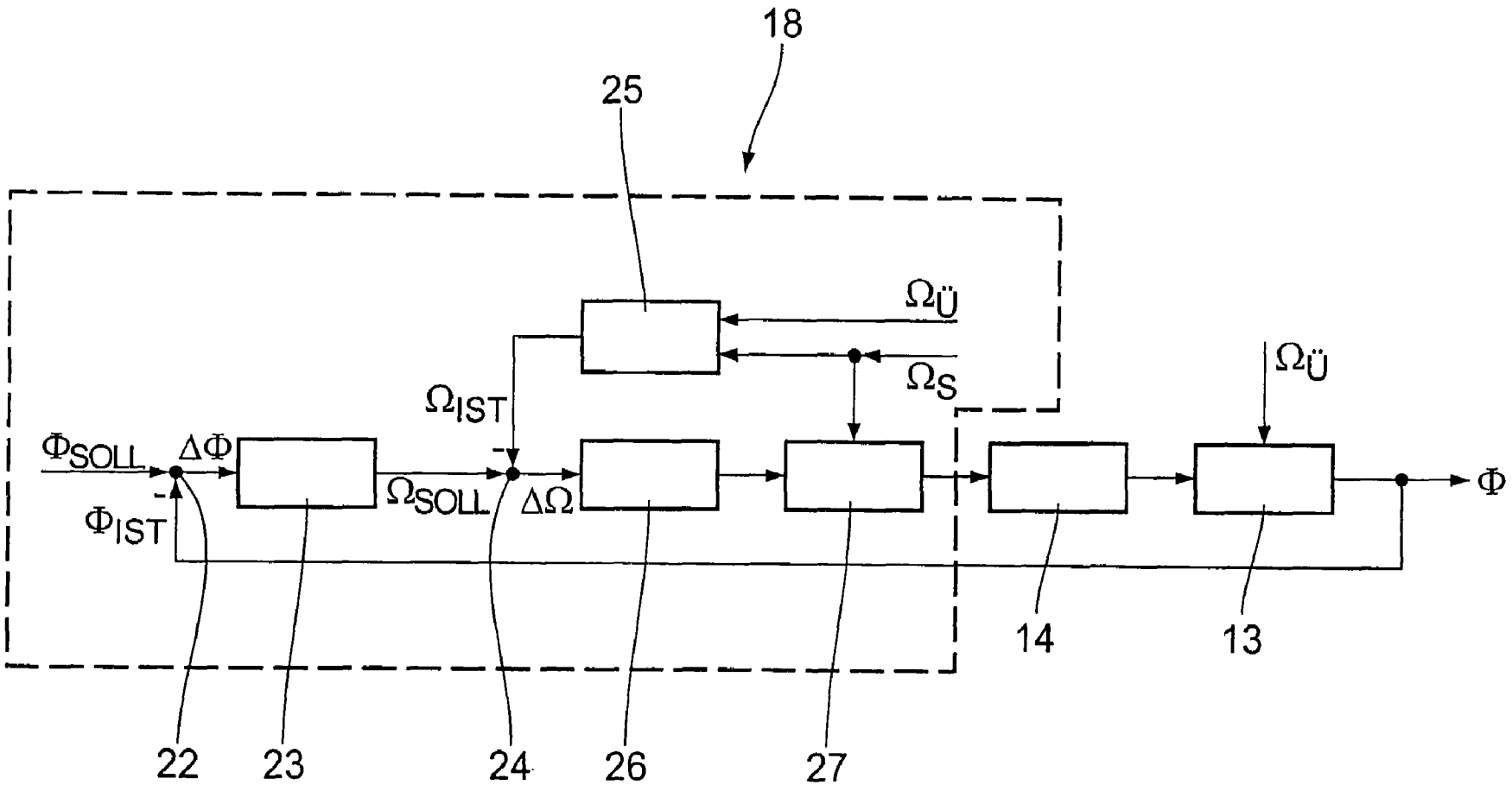

A method for adjusting the angle of rotation Φ realized in the adjusting and control device 18 according to a second embodiment is described below with reference to FIG. 3. The essential difference relative to the first embodiment is that the output parameter of the adjustment speed adjuster 26 and the rotational speed $\Omega_S$ of the DC motor 14 are fed to a disturbance parameter compensator 27, in which a self-inductance voltage of the DC motor 14 dependent on the rotational speed $\Omega_S$ of the DC motor 14 is compensated. The output parameter of the disturbance parameter compensator 27 is a desired value compensated as a function of the self-inductance voltage for the current-sourcing voltage of the DC motor 14, which is fed to a power-electronics circuit and is set by this at the DC motor 14. The dynamic response of the adjustment of the angle of rotation Φ can be improved by the disturbance parameter compensator 27.

Figure 4:
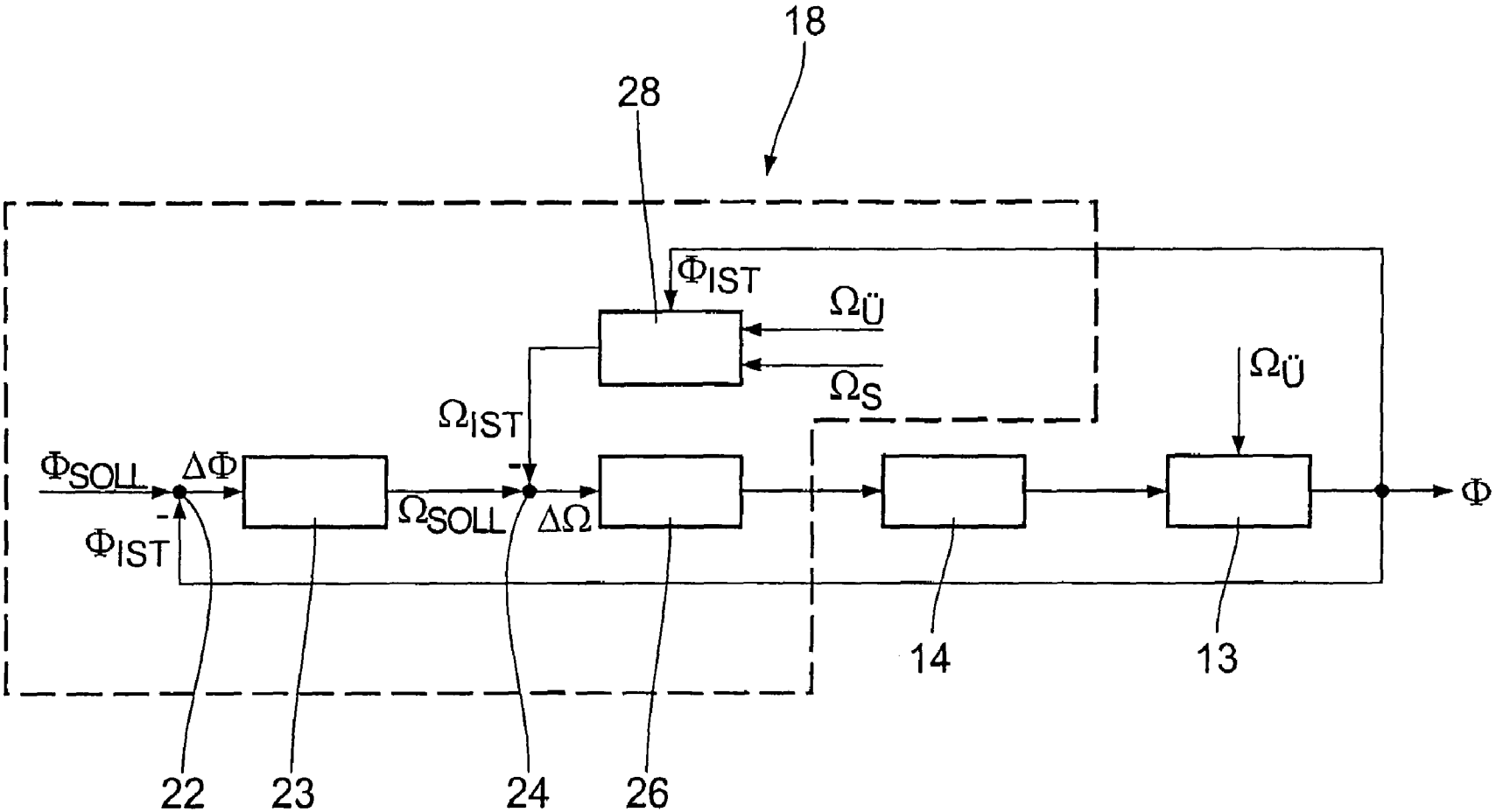

A method for adjusting the angle of rotation Φ realized in the adjusting and control device 18 according to a third embodiment is described below with reference to FIG. 4. The essential difference relative to the first and second embodiment is that the actual adjustment speed $\Omega_{IST}$ is calculated in a monitoring module 28. In the monitoring module 28, the phase adjuster 11 is modeled at least partially, with the modeled state parameters of the phase adjuster 11, especially the actual adjustment speed $\Omega_{IST}$, being corrected by a comparison of the monitoring module 28 by means of the actual angle of rotation $\Phi_{IST}$. Through the comparison by the monitoring module 28, drifting of the calculated actual adjustment speed $\Omega_{IST}$ from the real adjustment speed Ω due to the integrating system behavior is prevented. The actual adjustment speed $\Omega_{IST}$ can be calculated very precisely in the monitoring module 28.

Figure 5:
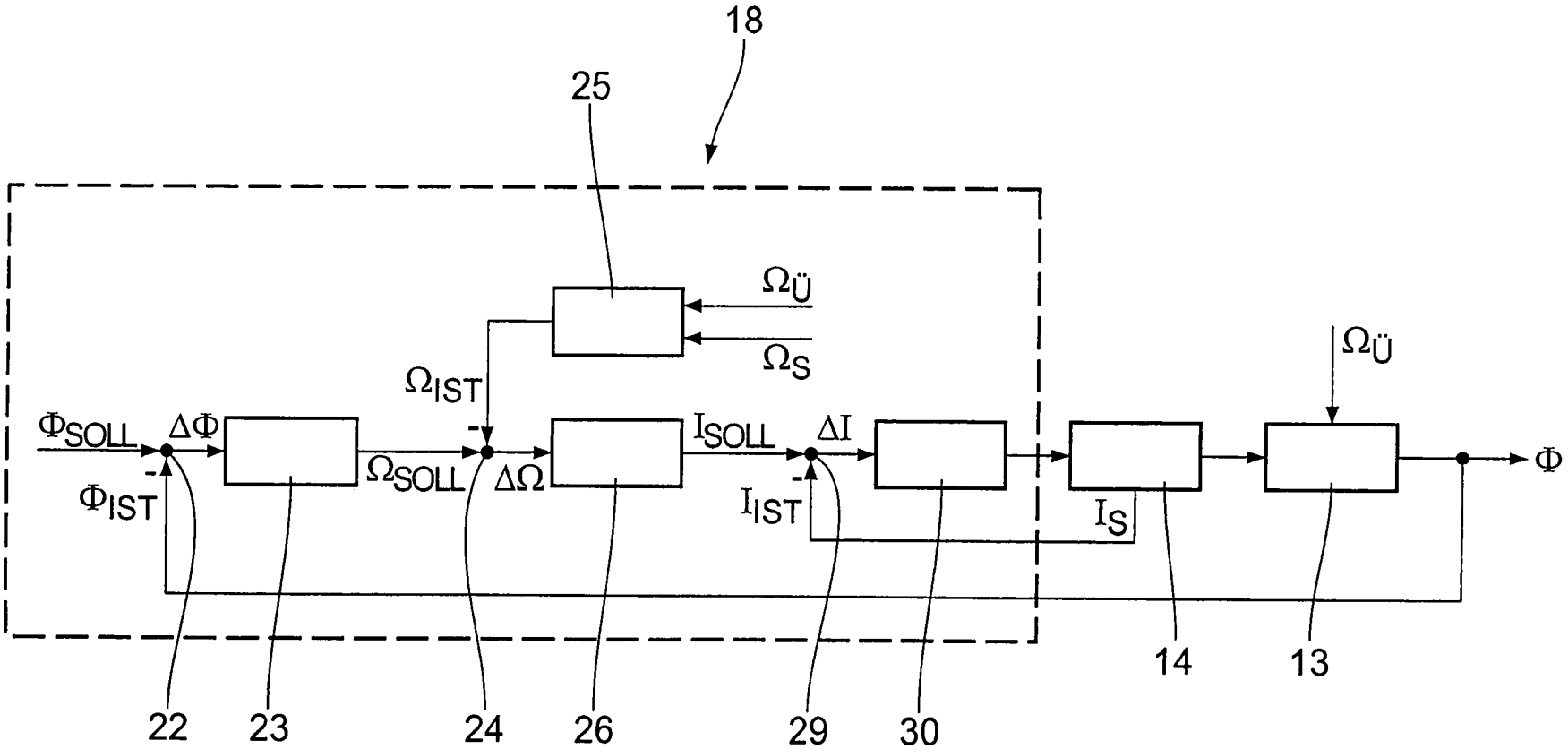

A method for adjusting the angle of rotation Φ realized in the adjusting and control device 18 according to a fourth embodiment is described below with reference to FIG. 5. The essential difference relative to the preceding embodiments is that the output parameters of the adjustment speed adjuster 26 is interpreted as a desired current $I_{SOLL}$ of the DC motor 14 and in a third computing model 29, first a current deviation ΔI between the desired current $I_{SOLL}$ and a measured actual current $I_{IST}$ of the DC motor 14 is calculated. Then, in a current adjuster 30 cascaded below the adjustment speed adjuster 26, a control parameter for adjusting the angle of rotation Φ dependent on the current deviation ΔI is calculated. The actual current $I_{IST}$ of the DC motor 14 is measured by means of the second actuator sensor 20. If the measurement of the actual current $I_{IST}$ is ideal, then this corresponds to the armature current $I_S$ of the DC motor 14. By adjusting the actual current $I_{IST}$ of the DC motor 14, a third control loop is cascaded below the first and second control loops. By adjusting the actual current $I_{IST}$, disturbance on the armature current $I_S$ and thus on the driving torque of the DC motor 14 can be stabilized instantaneously and exactly. In the current adjuster 30, there is also a current limiter, which is used for limiting the desired current $I_{SOLL}$ to a maximum current value $I_{MAX}$, whereby the armature current $I_S$ is also limited. The current limiting is used for protecting the DC motor 14 from overloading. The disturbance parameter compensation 27 and the monitoring module 28 can be combined with the method for adjusting the angle of rotation Φ according to the fourth embodiment.

With the method according to the invention, at a nominal power of 50 watts of the DC motor 14, instantaneous adjustment speeds Ω of up to 9000° crankshaft/sec for a maximum permissible overshoot of less than 2.5° crankshaft are achieved. The stationary accuracy of the relative angle of rotation Φ is less than ±1° crankshaft. Through the method according to the invention, a disturbance or perturbation, especially a change in the rotational speed $\Omega_K$ of the crankshaft 5 acting as disturbance, is also stabilized very well. Furthermore, if there is a current adjuster 30, disturbance on the armature current $I_S$ of the DC motor 14 is stabilized instantaneously and exactly.

The invention claimed is:

1. The method for adjusting a relative angle of rotation (Φ) between a camshaft (12) and a crankshaft (5) using an electromechanical phase adjuster (11), comprising the steps:

calculating a deviation in the angle of rotation (ΔΦ) between a desired angle of rotation ($\Phi_{SOLL}$) to be set and a determined actual angle of rotation ($\Phi_{IST}$) in a first control loop, calculating a desired adjustment speed ($\Omega_{SOLL}$) dependent on the deviation of the angle of rotation (ΔΦ) using an angle of rotation adjuster (23), calculating a deviation of the adjustment speed (ΔΩ) between a desired adjustment speed ($\Omega_{SOLL}$) and an actual adjustment speed ($\Omega_{IST}$) calculated from at least one measurement parameter in a second control loop cascaded below the first control loop, calculating an output parameter dependent on the deviation of the adjustment speed (ΔΩ) through an adjustment speed adjuster (26) cascaded below the angle of rotation adjuster (23), and adjusting the angle of rotation (Φ) as a function of the parameters calculated in the preceding steps using an electromechanical actuator (14).

2. The method according to claim 1, wherein the actual adjustment speed ($\Omega_{IST}$) is calculated at least from one rotational speed ($\Omega_S$) of the actuator (14) and a superimposed rotational speed ($\Omega_{Ü}$) of a drive shaft or a shaft coupled with the drive shaft.

3. The method according to claim 2, wherein the superimposed rotational speed ($\Omega_{Ü}$) is calculated at least from a rotational speed ($\Omega_K$) of the crankshaft (5).

4. The method according to claim 1, wherein the actual adjustment speed ($\Omega_{IST}$) is calculated in a monitoring module (28).

5. The method according to claim 1, wherein the output parameter of the adjustment speed adjuster (26) is a desired current ($I_{SOLL}$) of the actuator (14).

6. The method according to claim 5, further comprising the steps:

calculating a current deviation (ΔI) between the desired current ($I_{SOLL}$) and a measured actual current ($I_{IST}$) of the actuator (14) in a third control loop cascaded below the second control loop, and calculating a control parameter dependent on the current deviation (ΔI) using a current adjuster (30) cascaded below the adjustment speed adjuster (26) before the adjustment of the angle of rotation (Φ).

7. The method according to claim 5, wherein the desired current ($I_{SOLL}$) is limited to a maximum current value ($I_{MAX}$).

8. The phase adjuster (11) for adjusting a relative angle of rotation (Φ) between a camshaft (12) and a crankshaft (5), comprising a first computing module (22) for calculating a deviation in the angle of rotation (ΔΦ) between a desired angle of rotation ($\Phi_{SOLL}$) to be set and a determined actual angle of rotation ($\Phi_{IST}$) in a first control loop, an angle of rotation adjuster (23) for calculating a desired adjustment speed ($\Omega_{SOLL}$) dependent on the deviation in the angle of rotation ($\Delta\Phi$), a second computing module (24) for calculating a deviation in the desired adjustment speed ($\Delta\Omega$) between the desired adjustment speed ($\Omega_{SOLL}$) and an actual adjustment speed ($\Omega_{IST}$) calculated from at least one measurement parameter in a second control loop cascaded below the first control loop, an adjustment speed adjuster (26) cascaded below the angle of rotation adjuster (23) for calculating an output parameter dependent on the deviation in the desired adjustment speed ($\Delta\Omega$) for the adjustment speed, and an electromechanical actuator (14) for adjusting the angle of rotation ($\Phi$).

9. The phase adjuster according to claim 8, further comprising a third computing module (29) for calculating a current deviation ($\Delta I$) between a desired current ($I_{SOLL}$) and a measured actual current ($I_{IST}$) of the actuator (14) in a third control loop cascaded below the second control loop, and a current adjuster (30) cascaded below the adjustment speed adjuster (26) for calculating a control parameter dependent on the current deviation ($\Delta I$) before adjusting the angle of rotation ($\Phi$).

10. The phase adjuster according to claim 8, wherein the actuator (14) is a DC motor.

* * * * *